US006962237B2

(12) United States Patent
Underhill

(10) Patent No.: US 6,962,237 B2
(45) Date of Patent: Nov. 8, 2005

(54) LADDER STAND-OFF

(76) Inventor: Philip Orlando Underhill, 2 Brookside Dr., Apt. 1, Exeter, NH (US) 03833

( * ) Notice: Subject to any disclaimer, the term of this patent is extended or adjusted under 35 U.S.C. 154(b) by 0 days.

(21) Appl. No.: 10/680,648

(22) Filed: Oct. 7, 2003

(65) Prior Publication Data

US 2005/0072630 A1 Apr. 7, 2005

(51) Int. Cl.[7] ..... E06C 7/42
(52) U.S. Cl. ..... 182/107; 182/214; 248/238
(58) Field of Search ..... 182/107, 108, 182/128, 172, 206, 229, 214; 248/210, 238

(56) References Cited

U.S. PATENT DOCUMENTS

| | | | | | |
|---|---|---|---|---|---|
| 1,576,695 | A | * | 3/1926 | Weber | 182/107 |
| 2,592,006 | A | | 4/1952 | Burke | |
| 2,808,975 | A | * | 10/1957 | Palmquist | 182/107 |
| 3,072,218 | A | | 1/1963 | Peters | |
| 3,288,249 | A | * | 11/1966 | Gibson | 182/214 |
| 3,715,012 | A | * | 2/1973 | Perry | 182/107 |
| 4,369,860 | A | * | 1/1983 | Beane | 182/214 |
| 5,121,814 | A | * | 6/1992 | Southern | 182/214 |
| 5,323,875 | A | | 6/1994 | Kennett | |
| 5,373,913 | A | | 12/1994 | Santos | |
| 5,622,238 | A | | 4/1997 | Farmer | |
| 5,664,643 | A | | 9/1997 | Taylor, Jr. | |
| 5,743,356 | A | * | 4/1998 | Mitchell | 182/214 |
| 5,850,894 | A | * | 12/1998 | Busenhart | 182/214 |
| 5,899,296 | A | * | 5/1999 | Lantz | 182/214 |
| 6,152,262 | A | * | 11/2000 | Jung | 182/107 |
| 6,244,382 | B1 | * | 6/2001 | Labonte | 182/107 |
| 6,250,424 | B1 | * | 6/2001 | Laug | 182/107 |
| 6,691,825 | B2 | * | 6/2001 | Labonte | 182/107 |
| 6,394,229 | B1 | * | 5/2002 | Hastreiter | 182/107 |
| 6,408,983 | B1 | | 6/2002 | Widurski | |
| 6,427,803 | B1 | * | 8/2002 | Moore | 182/107 |
| 6,698,547 | B1 | * | 3/2004 | Uridel | 182/107 |
| 2001/0035313 | A1 | * | 11/2001 | Uridel et al. | 182/107 |
| 2002/0088668 | A1 | * | 7/2002 | Moore | 182/107 |
| 2003/0201139 | A1 | * | 10/2003 | Haig | 182/107 |
| 2004/0069567 | A1 | * | 4/2004 | Wollengerg et al. | 182/107 |
| 2004/0089501 | A1 | * | 5/2004 | Hockensmith | 182/107 |
| 2004/0216955 | A1 | * | 11/2004 | Unger | 182/206 |

FOREIGN PATENT DOCUMENTS

| | | | | |
|---|---|---|---|---|
| EP | 355504 | * | 8/1989 | 182/107 X |
| GB | 2161528 | * | 1/1986 | 182/107 X |

* cited by examiner

*Primary Examiner*—Bruce A. Lev
(74) *Attorney, Agent, or Firm*—Preti Flaherty

(57) ABSTRACT

A ladder stand-off includes a beam and two arms fixedly connected to the beam at two spaced apart points between the two ends of the beam. The two arms extend outward from the beam so as to be angularly divergent with respect to each other. A contact element is pivotally connected to a second, outer end of each arm. This arrangement allows the ladder stand-off to be used with flat, curved and corner surfaces. In one embodiment, the ladder stand-off is sized so that the distance between the fixed ends of the arms is less than the width of the ladder, while the distance between the outer ends of the arms is equal to or slightly greater than the width of the ladder. Furthermore, the distance between the outer ends of the arms is less than the length of the beam.

15 Claims, 9 Drawing Sheets

LADDER STAND-OFF

BACKGROUND OF THE INVENTION

This invention relates generally to ladder stand-offs and more particularly to ladder stand-offs useful in corner applications.

Ladders are commonly used for many tasks to enable the user to reach locations that otherwise could not be reached. One of the most common types of ladders is the lean-on ladder which comprises a pair of laterally spaced side rails interconnected by a plurality of longitudinally spaced rungs. In use, the bottom of the ladder is supported on the ground or a floor and the top of the ladder is placed against a wall or similar vertical surface. Generally, lean-on ladders should be oriented at an angle of lean (i.e., the angle between the ladder and the ground or floor) of approximately 70–80 degrees for safe and stable deployment.

It is known to use ladder attachments such as stand-offs with lean-on ladders to increase ladder stability. Such devices are attached to the upper portion of the ladder and position the ladder away from the wall that it is leaned against. Stand-offs designed to be used in corner applications have also been proposed. However, many known stand-offs are not readily used with both flat and corner surfaces or require manual adjustment of various moving parts to permit use with different surfaces. Such moving parts are susceptible to becoming lost or broken. Many current stand-offs are also big and bulky and thus not suitable for use in tight spaces.

Accordingly, there is a need for a ladder stand-off that is compact and easy to use and can be used on both flat and corner surfaces without excessive adjustable parts.

SUMMARY OF THE INVENTION

The above-mentioned need is met by the present invention, which provides a ladder stand-off including a beam and two arms fixedly connected to the beam at two spaced apart points between the two ends of the beam. The two arms extend outward from the beam so as to be angularly divergent with respect to each other. A contact element is pivotally connected to a second, outer end of each arm. The ladder stand-off also includes means for detachably securing the beam to a ladder. In one embodiment, the ladder stand-off is sized so that the distance between the fixed ends of the arms is less than the width of the ladder, while the distance between the outer ends of the arms is equal to or slightly greater than the width of the ladder. Furthermore, the distance between the outer ends of the arms is less than the length of the beam.

The present invention and its advantages over the prior art will be more readily understood upon reading the following detailed description and the appended claims with reference to the accompanying drawings.

DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
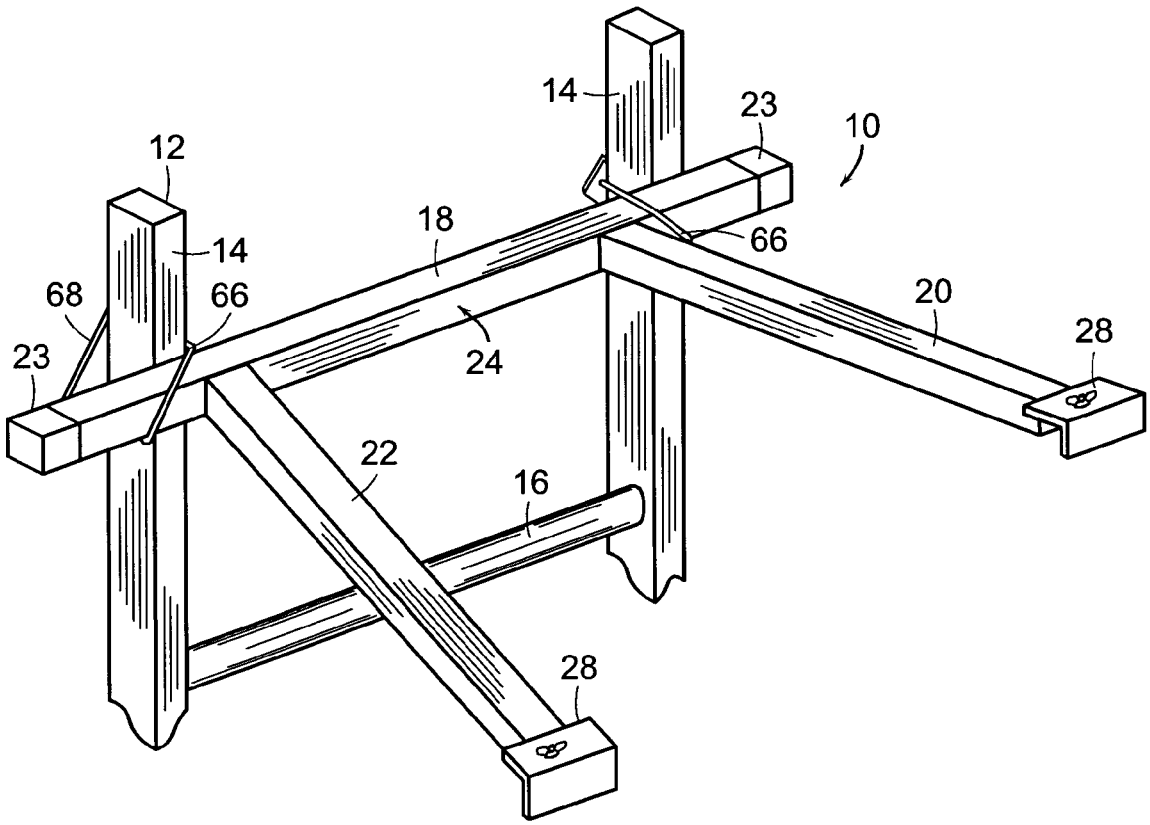
FIG. 1 is a perspective view of a ladder stand-off detachably secured to a ladder.

Referring to the drawings wherein identical reference numerals denote the same elements throughout the various views, FIGS. 1–6 show a ladder stand-off 10 detachably secured to a conventional ladder 12. The ladder 12 illustrated in the Figures is a common lean-on ladder having a pair of laterally spaced side rails 14 interconnected by a plurality of longitudinally spaced rungs 16. The ladder stand-off 10 can be used with extendible and non-extendible ladders. It is also possible to use the ladder stand-off 10 with folding step ladders when folded closed and used in the manner of a lean-on ladder (i.e., leaned against a wall or other vertical surface).

The ladder stand-off 10 includes a primary support beam 18 and first and second arms 20 and 22 fixedly connected to the beam 18. The beam 18 should be suitably strong and rigid and is preferably a straight piece having a predetermined length. End caps 23 made of a relatively soft, pliant material are provided on each end of the beam 18. In one embodiment, the beam 18 can comprise square aluminum tubing, which is suitably strong and rigid while being relatively lightweight. The two arms 20 and 22 generally have similar material characteristics and are preferably, although not necessarily, made of the same material as the beam 18.

Each of the first and second arms 20 and 22 is joined, at a first end thereof, to a first surface 24 of the beam 18. The first and second arms 20 and 22 are fixedly joined, such as by welding or the like, to the beam 18. The first arm 20 is joined to the beam 18 at a first point between the two ends of the beam 18, and the second arm 22 is joined to the beam 18 at a second point between the two ends of the beam 18. The first and second connection points are spaced apart by a predetermined distance, with the first point being spaced a relatively short distance from one end of the beam 18, and the second point being spaced the same distance from the other end of the beam 18. The distance that the first and second connection points are located in from the respective ends of the beam 18 is sufficient to permit the ladder stand-off 10 to be attached to a ladder, in a manner described below.

Figure 2:
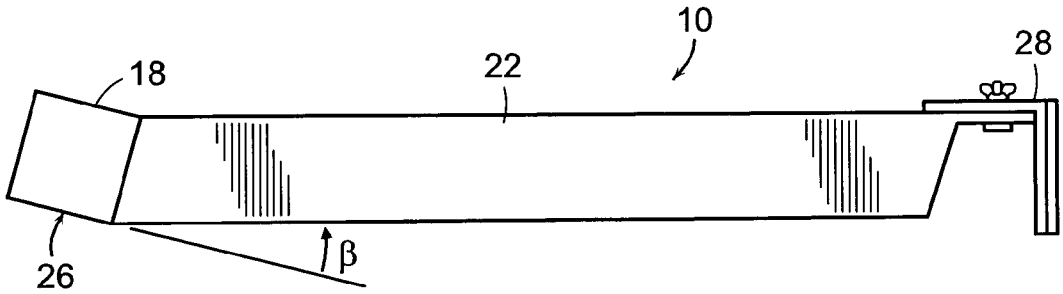
FIG. 2 is a side view of the ladder stand-off of FIG. 1, separate from the ladder.
Figure 3:
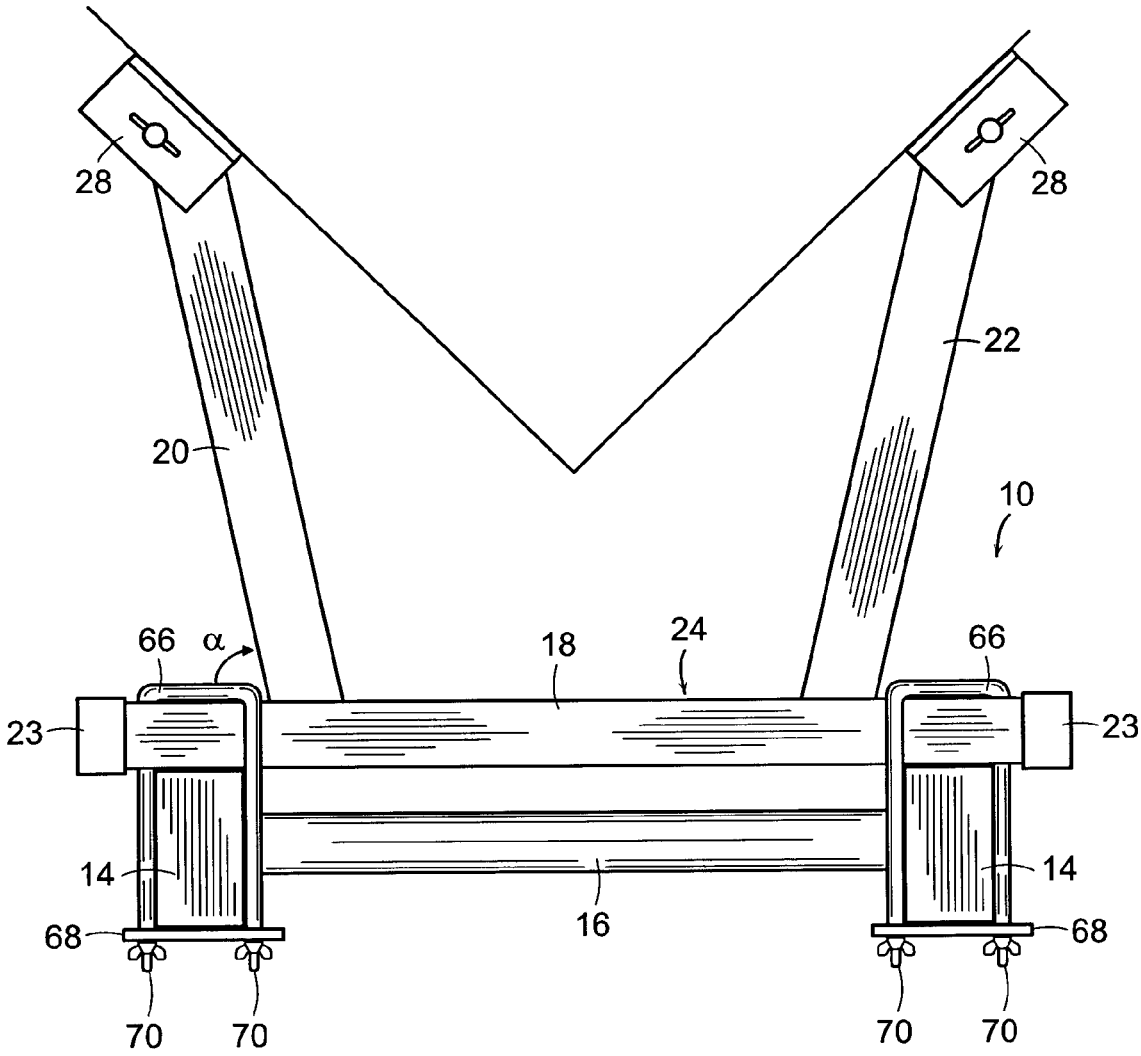
FIG. 3 is a top view of the ladder stand-off in use with an outside corner.
Figure 4:
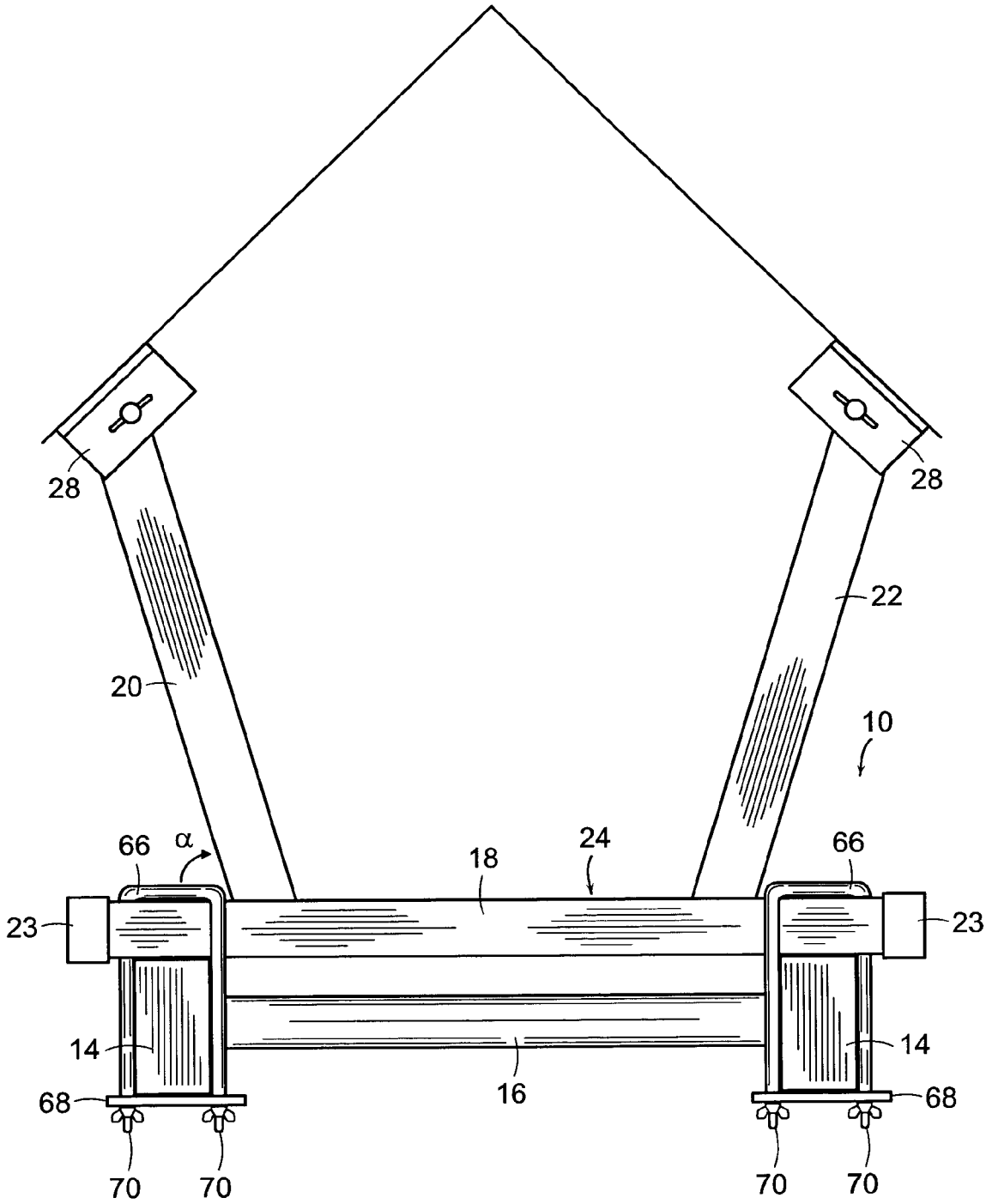
FIG. 4 is a top view of the ladder stand-off in use with an inside corner.
Figure 5:
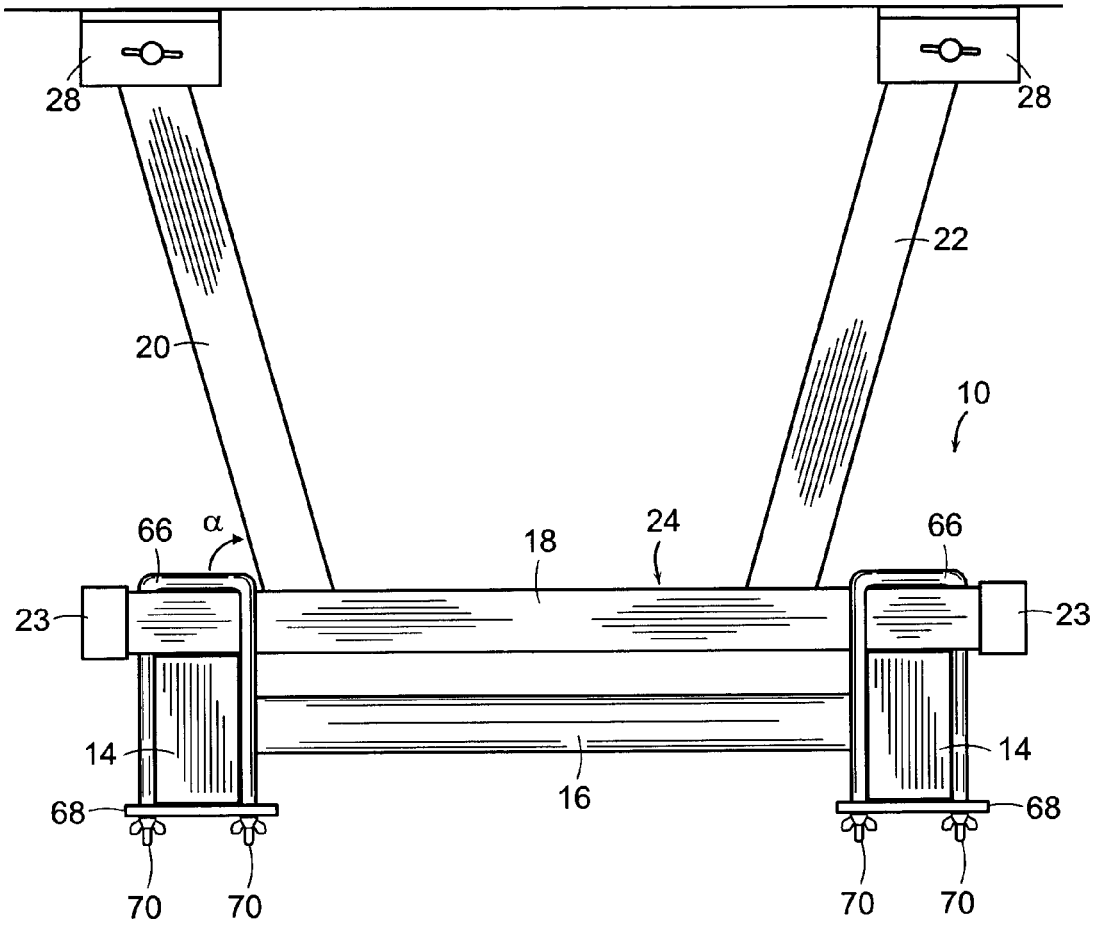
FIG. 5 is a top view of the ladder stand-off in use with a flat wall.

The first and second arms 20 and 22 extend outwardly from the first beam surface 24 so as to be angularly divergent with respect to each other, generally defining an angle therebetween that is less than 90 degrees. Specifically, the first and second arms 20 and 22 each forms an outside angle α with the first beam surface 24 (in a direction parallel to the longitudinal axis of the beam 18) that is less than 90 degrees. In this case, the distal ends of the first and second arms 20 and 22 are spaced apart a distance that is greater than the distance that the fixed ends of the first and second arms 20 and 22 are spaced apart. The angle α is generally in the range of 70–85 degrees. The first and second arms 20 and 22 are also angled relative to a second beam surface 26, which is perpendicular to the first beam surface 24. As best seen in FIG. 2, the first and second arms 20 and 22 are both angled upward at an angle β relative to the second beam surface 26. The angle β will typically be in the range of 10–20 degrees, depending the desired angle of lean that the ladder 12 is to make with respect to the ground or floor.

Figure 7:
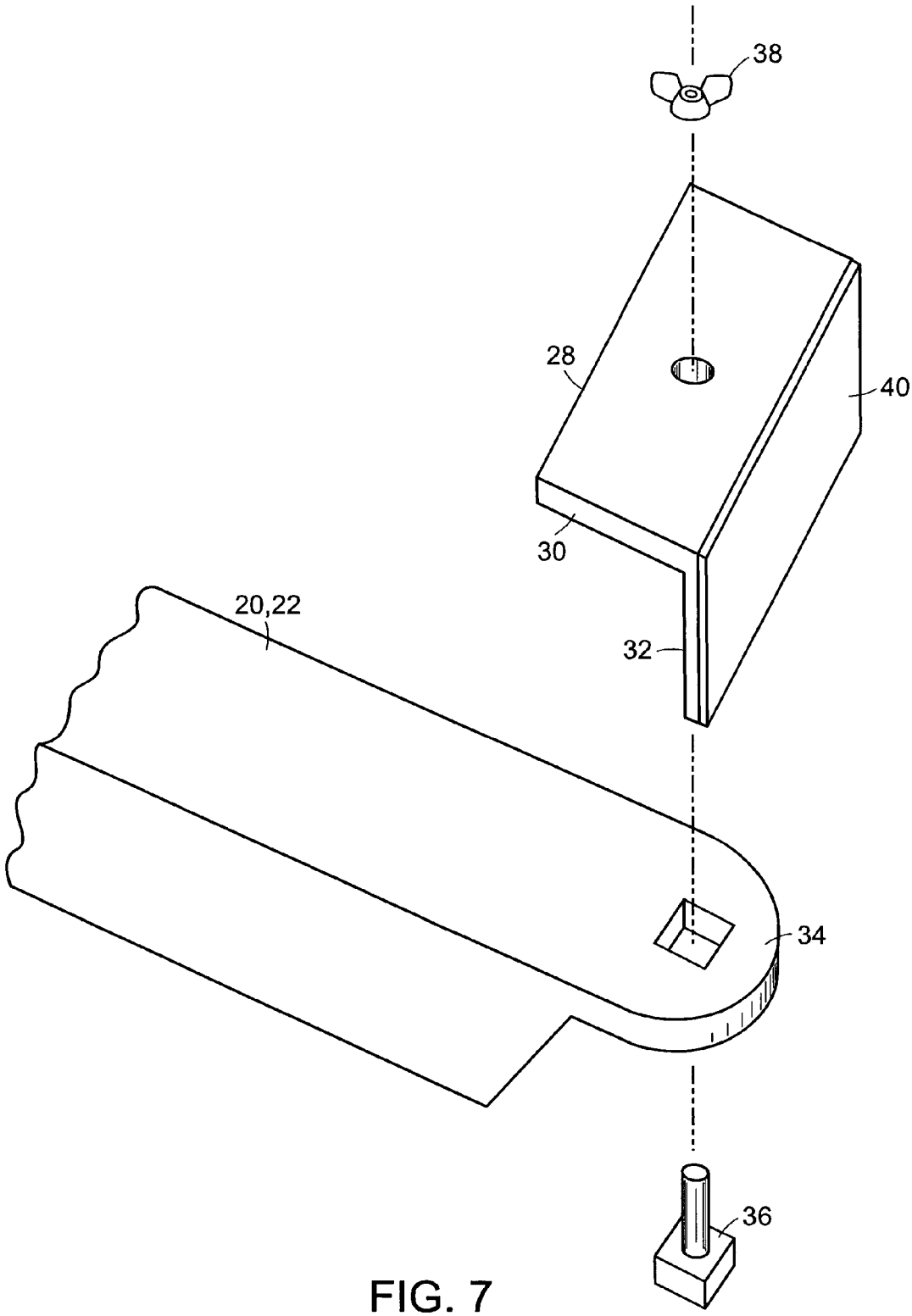
FIG. 7 is an exploded view of a first embodiment of a pivoting contact element used with the ladder stand-off.

The ladder stand-off 10 includes a contact element 28 pivotally connected to the distal end of each of the first and second arms 20 and 22. Referring to FIG. 7, each contact element 28 comprises an L-shaped member having perpendicular first and second sections 30 and 32. Each arm 20 and 22 has a flange 34 extending longitudinally outward from its distal end, coextensive with the upper surface of the arm. The contact elements 28 are positioned with the first section 30 overlying the flange 34 and the second section 32 extending downward therefrom. Pivot pins 36 are provided through aligned holes formed in the first sections 30 and the flanges 34 to pivotally mount the contact elements 28 to the corresponding arm 20, 22. In one possible embodiment, the pivot pins 36 are carriage bolts secured with wing nuts 38. Other types of fastening means can alternatively be used. The flanges 34 are rounded so that the contact elements 28 are able to pivot relative to the respective arm 20, 22 through a full range of motion of at least 180 degrees. Each contact element 28 has a resilient pad 40 mounted on the outside surface of its second section 32. The resilient pads 40, which contact and protect the surface the ladder 12 is leaned against when in use, can be corrugated with the corrugations extending vertically so that any water or moisture present will be free to drain away. The contact elements 28 and the pads 40 preferably have sufficient width, such as four inches or more, so as to ensure stable, slip-free contact with the support surface.

Figure 8:
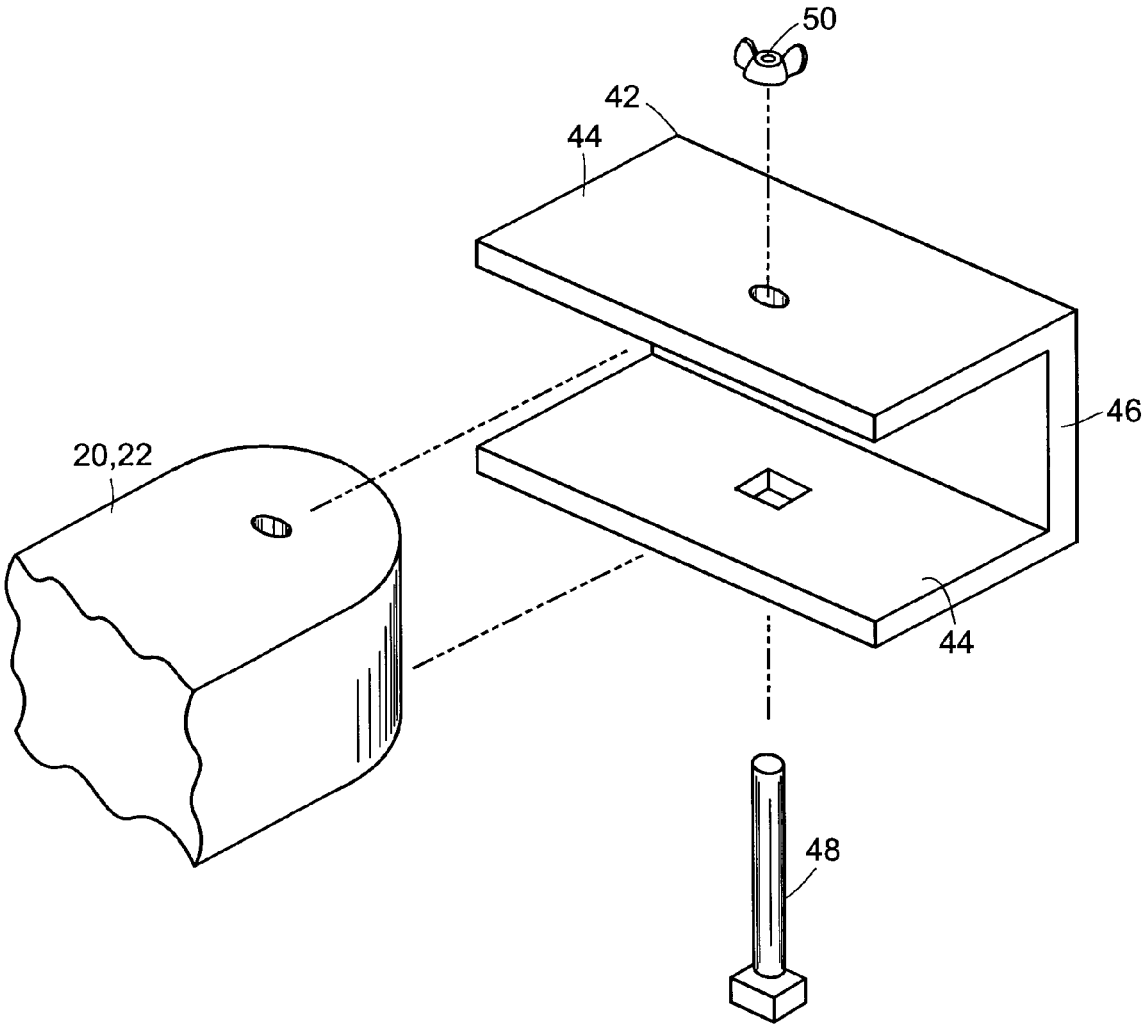
FIG. 8 is an exploded view of a second embodiment of a pivoting contact element used with the ladder stand-off.

Referring to FIG. 8, an alternative contact element 42 is shown. In this embodiment, each contact element 42 comprises a U-shaped member having two parallel side legs 44 joined by a central web 46 defining an outer contact surface. The contact element 42 is positioned with the side legs 44 straddling the distal end of the corresponding arm 20, 22. A pivot pin 48, preferably but not necessarily a carriage bolt secured by a wing nut 50, is provided through aligned holes formed in the side legs 44 and the corresponding arm 20, 22 to pivotally mount the contact elements 42. Other types of fastening means can alternatively be used. The distal ends of the arms 20 and 22 are rounded so that the contact elements 42 are able to pivot relative to the respective arm 20, 22 through a full range of motion of at least 180 degrees. The entire U-shaped contact element 42 can be made of a resilient material such as rubber with vertically extending corrugations formed on the outer contact surface of the central web 46.

Figure 9:
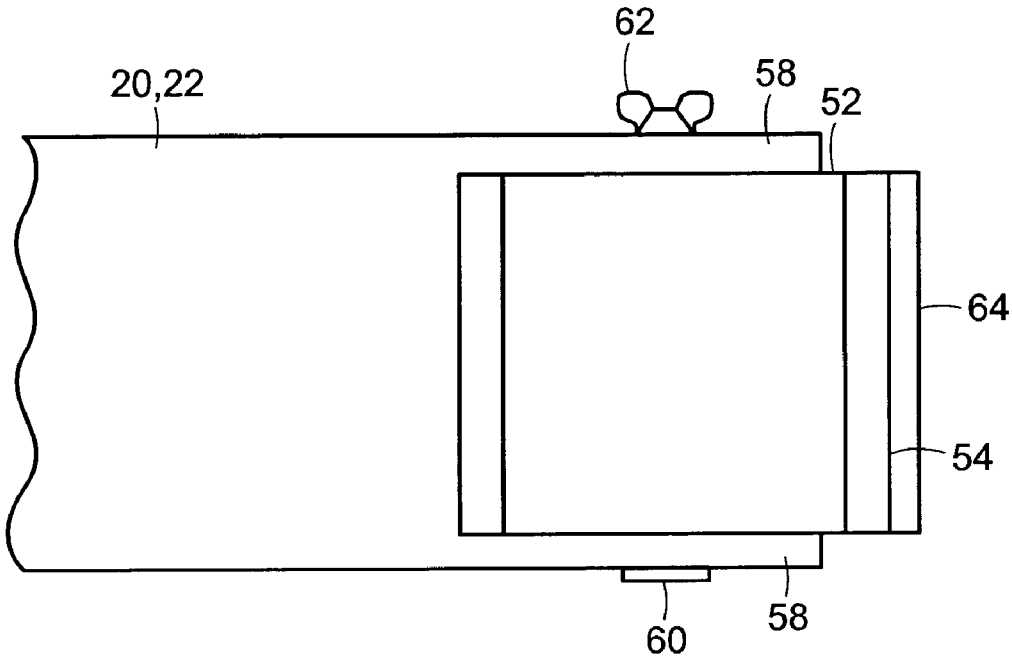
FIG. 9 is side view of a third embodiment of a pivoting contact element used with the ladder stand-off.
Figure 10:
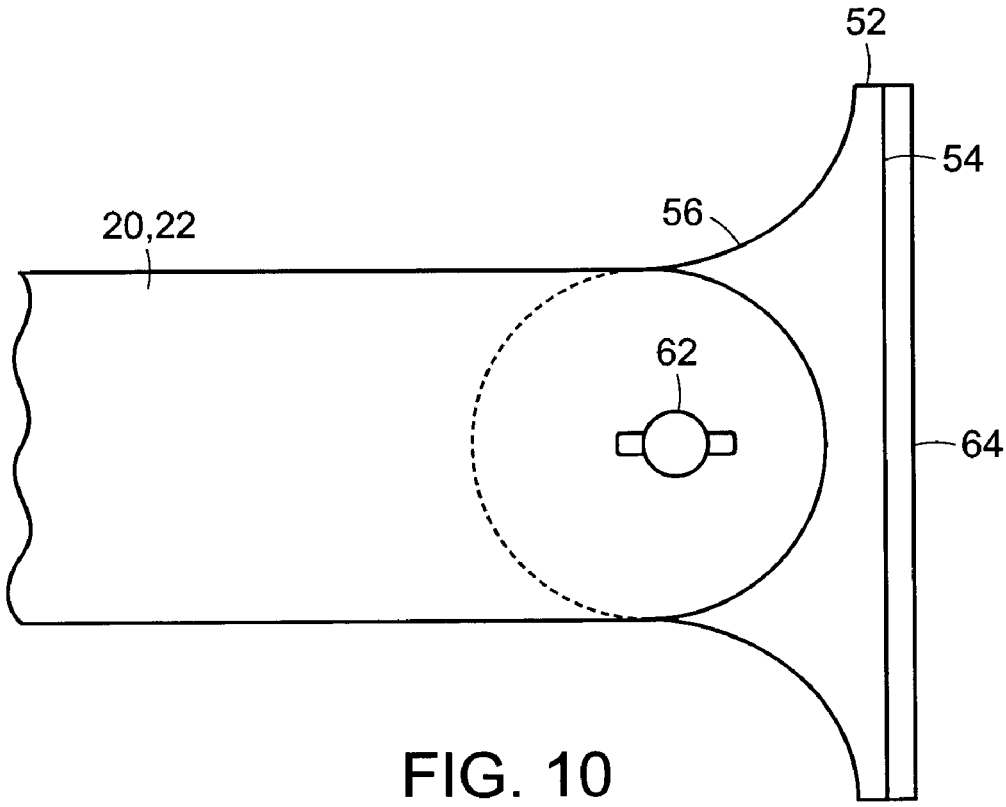
FIG. 10 is a top view of the third embodiment of a pivoting contact element used with the ladder stand-off.

Referring to FIGS. 9 and 10, yet another alternative contact element 52 is shown. In this embodiment, each contact element 52 a flat contact surface 54 and a rounded surface 56. Each arm 20 and 22 has a pair of flanges 58 extending longitudinally outward from its distal end, coextensive with the lower and upper surfaces of the arm. The contact element 52 is positioned between the flanges 58 with the flat contact surface 54 facing outward. A pivot pin 60, preferably but not necessarily a carriage bolt secured by a wing nut 62, is provided through aligned holes formed in the flanges 58 and the contact element 52 to pivotally mount the contact elements 52 to the corresponding arm 20, 22. The rounded surface 56 permits the contact elements 52 to pivot relative to the respective arm 20, 22 through a full range of motion of at least 180 degrees. The contact element 52 can either be made of a resilient material or have a resilient pad 64 mounted on the flat contact surface 54.

The ladder stand-off 10 is generally sized based on the size of the ladder that it is to be used with. In the illustrated embodiment, for example, the length of the beam 18 is just slightly longer than the width of the ladder 12. Furthermore, the distance that the distal ends of the first and second arms 20 and 22 are spaced apart is preferably equal to, or slightly greater than, the width of the ladder 12, while being less than the length of the beam 18. For example, for a ladder that is 19 inches wide, (which is a typical ladder width), a beam length of 21 inches would be desirable. The distance between the first and second connection points of the fixed ends of the first and second arms 20 and 22 is approximately 12 inches. The arms 20 and 22 in the illustrated embodiment are 13.5 inches long and define an angle α of 75 degrees, which results in a distance between the distal ends of about 19 inches. Many other sizes and dimensions are possible.

The ladder stand-off 10 is detachably secured to the ladder 12 through any suitable fastening means. One possible means for detachably securing the ladder stand-off 10 to the ladder 12 comprises a pair of U-bolts 66 that are threaded at both terminal ends, a pair of flat braces 68 having laterally spaced holes for receiving the legs of the U-bolts 66, and four threaded elements such as wing nuts 70. Each U-bolt 66 is placed over the beam 18 so that the bottom of the "U" abuts the first beam surface 24 and the two legs of the U-bolt 66 extend over the beam 18 and on opposite sides of the respective side rails 14. The flat braces 68 are mounted over the U-bolt legs so as to engage the back of the respective side rails 14. Tightening the wing nuts 70 on the threaded legs of the U-bolts 66 thereby secures the beam 18 to the side rails 14. The ladder stand-off 10 is preferably, but not necessarily, attached to the ladder 12 with the beam 18 adjacent to the top most of the ladder rungs 16. In this case, the innermost leg of each U-bolt 66 can be positioned over the rung 16 (as shown in the Figures) so as to prevent the ladder stand-off 10 from slipping downward relative to the ladder 12. Other means for detachably securing the ladder stand-off 10 to the ladder 12 can also be used.

Figure 11:
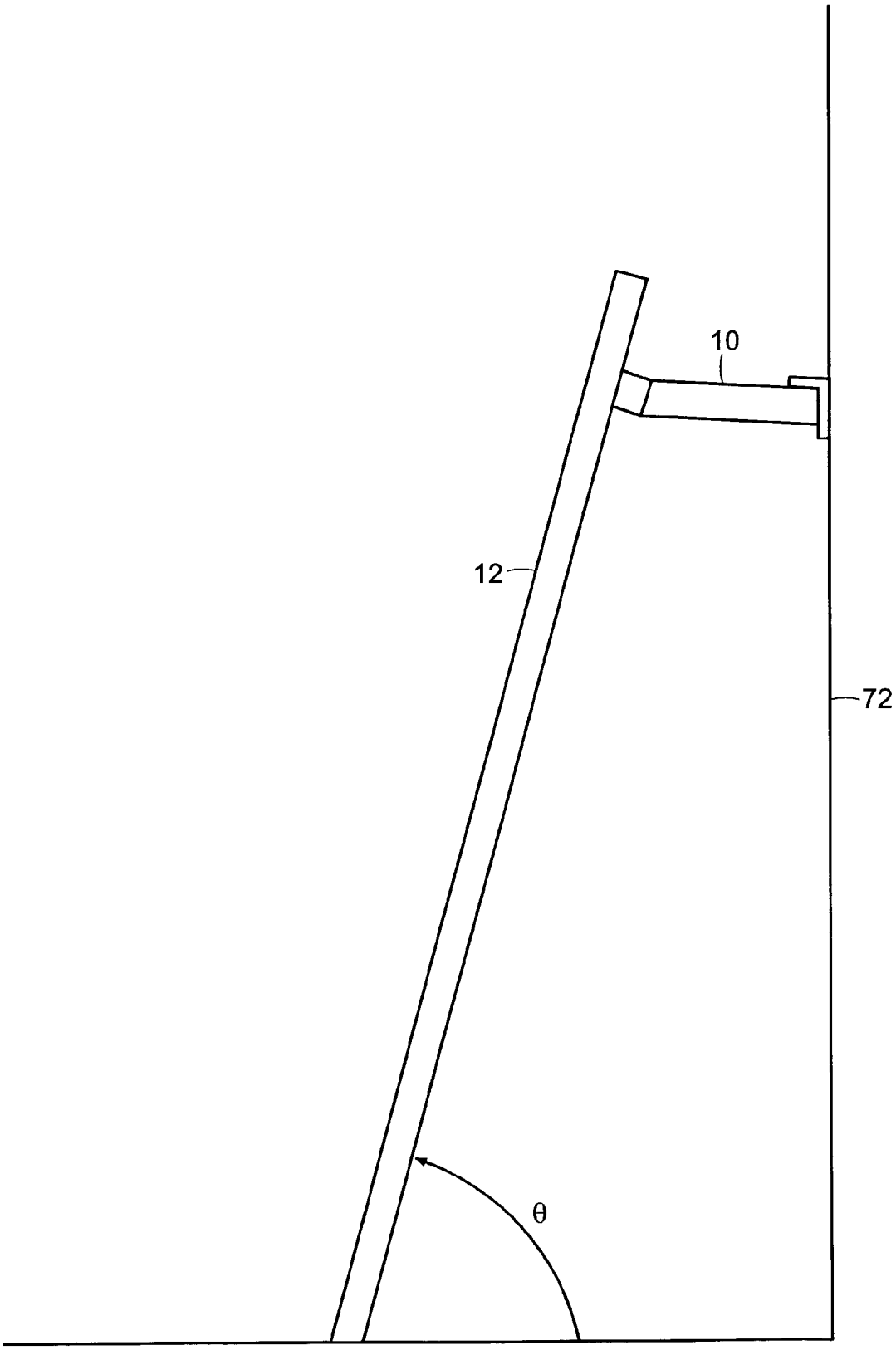
FIG. 11 shows a ladder having the ladder stand-off in use.

With the ladder stand-off 10 detachably secured thereto, the ladder 12 is placed on a horizontal surface, such as the ground or floor, and leaned against a vertical surface 72 (see FIG. 11) so that the resilient pads 40 of the contact elements 28 engage the vertical surface 72. The ladder 12 is oriented so that the resilient pads 40 are substantially flush against the vertical surface 72 and the arms 20 and 22 are parallel to the ground or floor or angled slightly downward as shown in FIG. 11. With this arrangement, the upward angle β of each arm 20, 22 relative to the beam 18 determines the angle of lean θ of the ladder 12 with respect to the ground or floor. For example, if the upward angle β is 12 degrees, then the ladder 12 would define an angle of 78 degrees with the ground or floor if the arms 20 and 22 are parallel to the ground or floor or an angle of about 75 degrees if the arms 20 and 22 are angled downward about three degrees.

Figure 6:
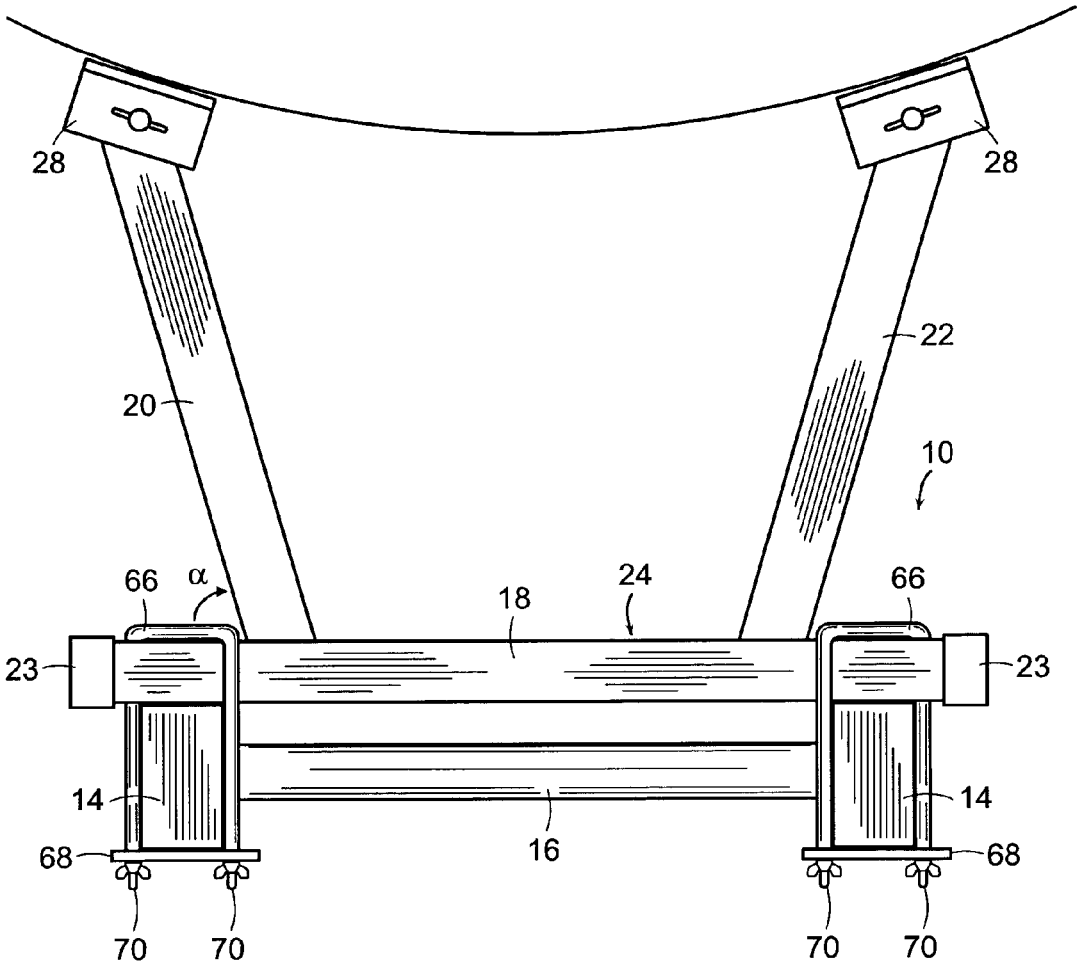
FIG. 6 is a top view of the ladder stand-off in use with a curved wall.

The pivoting nature of the contact elements 28 allows the ladder stand-off 10 to be used with a variety of vertical surfaces, including an outside corner (FIG. 3), an inside corner (FIG. 4), a flat wall (FIG. 5), and a curved wall (FIG. 6). In addition to this versatility, the ladder stand-off 10 provides the advantage of being relatively compact. Thus, when using a ladder equipped with the ladder stand-off 10, it is easier to avoid hitting or becoming entangled with wires, tree limbs or other such obstacles around the work site. The narrow spacing of the arms 20 and 22 is helpful when working in tight spaces due to structural characteristics of the work site, such as a window set very close to a corner. Another advantage of the ladder stand-off 10 is that because there are very few moving parts, there is little chance of parts becoming lost or damaged.

The ladder stand-off 10 can also be used in the manner of a ridge hook. That is, with the ladder stand-off 10 attached, the ladder 12 can be placed flat on a pitched roof with the ladder stand-off 10 situated over the peak of the roof. The arms 20 and 22 are oriented downward so that the contact elements 28 abut the roof on the other side of the peak. With this set-up, the ladder stand-off 10 will secure the ladder 12 on the roof, allowing a worker to walk on the ladder 12. When used in this manner, the innermost leg of each U-bolt 66 would preferably be positioned under the adjacent ladder rung 16 so as to prevent the ladder 12 from slipping downward relative to the ladder stand-off 10.

While specific embodiments of the present invention have been described, it will be apparent to those skilled in the art that various modifications thereto can be made without departing from the spirit and scope of the invention as defined in the appended claims.

What is claimed is:

1. A ladder stand-off for use with a ladder having a pair of laterally spaced side rails defining a ladder width, said ladder stand-off comprising:

a beam having first and second ends;

a first arm fixedly connected at a first end thereof to said beam at a first point located between said first and second beam ends;

a second arm fixedly connected at a first end thereof to said beam at a second point located between said first and second beam ends, said second point being spaced from said first point a predetermined distance, wherein said first and second arms extend outward from said beam so as to be angularly divergent with respect to each other and define an unobstructed space therebetween;

a contact element pivotally connected to a second end of each of said first and second arms, wherein each contact element pivots substantially horizontally;

whereby said ladder stand-off can be used with a variety of surfaces including outside corners defining an angle of about 90 degrees; and means for detachably securing said beam to said ladder.

2. The ladder stand-off of claim 1 wherein said beam is straight.

3. The ladder stand-off of claim 1 wherein each contact element comprises an L-shaped member having first and second sections, said first section being pivotally connected to said second end.

4. The ladder stand-off of claim 1 wherein each contact element comprises a U-shaped member having two side legs joined by a central web, said side legs straddling said second end.

5. The ladder stand-off of claim 1 wherein said second end of each arm includes a pair of flanges and each contact element is positioned between a corresponding pair of said flanges.

6. The ladder stand-off of claim 1 wherein said second ends of said first and second arms are spaced apart a distance that is less than the length of said beam.

7. The ladder stand-off of claim 1 wherein said beam, said first arm and said second arm comprise square tubing.

8. A ladder stand-off for use with a ladder having a pair of laterally spaced side rails defining a ladder width, said ladder stand-off comprising:

a beam having first and second ends;

a first arm fixedly connected at a first end thereof to said beam at a first point located between said first and second beam ends;

a second arm fixedly connected at a first end thereof to said beam at a second point located between said first and second beam ends, said second point being spaced from said first point a predetermined distance, wherein said first and second arms extend outward from said beam;

a contact element pivotally connected to a second end of each of said first and second arms, wherein each contact element pivots substantially horizontally;

whereby said ladder stand-off can be used with a variety of surfaces including outside corners defining an angle of about 90 degrees; and means for detachably securing said beam to said ladder.

9. The ladder stand-off of claim 8 wherein said beam is straight.

10. The ladder stand-off of claim 8 wherein each contact element comprises an L-shaped member having first and second sections, said first section being pivotally connected to said second end.

11. The ladder stand-off of claim 8 wherein each contact element comprises a U-shaped member having two side legs joined by a central web, said side legs straddling said second end.

12. The ladder stand-off of claim 8 wherein said second end of each arm includes a pair of flanges and each contact element is positioned between a corresponding pair of said flanges.

13. The ladder stand-off of claim 8 wherein said second ends of said first and second arms are spaced apart a distance that is less than the length of said beam.

14. The ladder stand-off of claim 8 wherein said first and second arms define an angle therebetween that is less than 90 degrees.

15. The ladder stand-off of claim 8 wherein said beam, said first arm and said second arm comprise square tubing.

* * * * *